US006564993B1

(12) United States Patent
Wassink

(10) Patent No.: US 6,564,993 B1
(45) Date of Patent: May 20, 2003

(54) TOTE BOX WITH CORNER ENHANCERS AND STRENGTHENER CLIPS

(75) Inventor: Chad Wassink, Zeeland, MI (US)

(73) Assignee: Bradford Company, Holland, MI (US)

( * ) Notice: Subject to any disclaimer, the term of this patent is extended or adjusted under 35 U.S.C. 154(b) by 0 days.

(21) Appl. No.: 10/127,626

(22) Filed: Apr. 22, 2002

(51) Int. Cl.[7] ..... B65D 5/44

(52) U.S. Cl. ..... 229/199; 220/642; 220/652; 229/918; 229/919; 493/89; 493/115

(58) Field of Search ..... 229/198.1, 199, 229/915, 918, 919; 206/509, 512; 220/4.28, 4.33, 641, 642, 646, 651, 652; 493/89, 114, 115, 136

(56) References Cited

U.S. PATENT DOCUMENTS

| | | | | |
|---|---|---|---|---|
| 249,561 | A | | 11/1881 | Weston |
| 544,525 | A | | 8/1895 | Bartlett |
| 825,523 | A | | 7/1906 | Dewey |
| 959,734 | A | | 5/1910 | Hall |
| 1,046,018 | A | | 12/1912 | Reber |
| 2,304,853 | A | | 12/1942 | Shaw |
| 2,496,965 | A | | 2/1950 | Swingle |
| 3,220,633 | A | | 11/1965 | Swane |
| 3,223,309 | A | | 12/1965 | Chiorri |
| 3,226,008 | A | | 12/1965 | Chiorri |
| 3,989,397 | A | | 11/1976 | Baker |
| 4,172,623 | A | | 10/1979 | Anderson |
| 4,210,274 | A | | 7/1980 | Leonard |
| 4,366,905 | A | * | 1/1983 | Forshee ..... 220/4.33 |
| 4,619,365 | A | | 10/1986 | Kelly et al. |
| 4,712,942 | A | | 12/1987 | Brown |
| 4,720,013 | A | | 1/1988 | Nichols et al. |
| 4,763,831 | A | * | 8/1988 | Huang et al. ..... 229/198.1 |
| 4,787,553 | A | * | 11/1988 | Hoskins ..... 229/915 |
| 4,971,201 | A | | 11/1990 | Sathre |
| 5,033,669 | A | | 7/1991 | Federico |
| 5,037,027 | A | | 8/1991 | Nichols |
| 5,119,950 | A | | 6/1992 | Takemura |
| 5,295,632 | A | | 3/1994 | Zink et al. |
| 5,335,789 | A | | 8/1994 | Taravella et al. |
| 5,337,950 | A | | 8/1994 | Bower |
| 5,377,857 | A | | 1/1995 | Taravella et al. |
| 5,431,336 | A | | 7/1995 | Clee |
| 5,462,221 | A | | 10/1995 | Zink et al. |
| 5,520,477 | A | | 5/1996 | Fink |
| 5,531,326 | A | | 7/1996 | Hummel et al. |
| 5,538,178 | A | | 7/1996 | Zink et al. |
| 6,305,601 | B1 | | 10/2001 | Bazany et al. |
| 6,349,877 | B1 | | 2/2002 | Bradford |
| D454,692 | S | | 3/2002 | Bublitz |
| D455,266 | S | | 4/2002 | Bradford |
| 6,460,724 | B1 | * | 10/2002 | Bradford ..... 220/642 |

FOREIGN PATENT DOCUMENTS

| | | |
|---|---|---|
| GB | 2 277 731 | 11/1994 |

OTHER PUBLICATIONS

FEBRA—Kunststoffe GmbH & Co., Klingenberger Str. 2, D–74336 Brackenheim, Germany, product brochure and photographs, (Jan. 1996).

Zink et al., Reexamination Certificate of U.S. Pat. No. 5,295,632 issued Apr. 1998.

* cited by examiner

*Primary Examiner*—Gary E. Elkins
(74) *Attorney, Agent, or Firm*—Wood, Herron & Evans, L.L.P.

(57) ABSTRACT

A tote box and method of assembling a tote box is disclosed which incorporates a box, four corner enhancers, four corner strengthener clips and a top rail which is secured over the top edge of the erected walls of the box. The walls of the box are held together with corner enhancer assemblies without the benefit of any mechanical fasteners such as rivets or the like. The corner strengthener clips are attached to the corner enhancers to create the corner enhancer assemblies. The top rail may be secured onto the box by a hook on at least one of the side walls of the top rail, which engages tabs of the box walls. The top rail may have a vertical lip which facilitates stacking multiple tote boxes.

21 Claims, 4 Drawing Sheets

TOTE BOX WITH CORNER ENHANCERS AND STRENGTHENER CLIPS

FIELD OF THE INVENTION

This invention relates to tote boxes and more particularly to tote boxes made from foldable box blanks and having self locking rails to hold the blanks in an erected, assembled relationship.

BACKGROUND OF THE INVENTION

Containers which are returnable/reusable are useful for the transportation, storage, and display of goods in commerce. Such containers, commonly called tote boxes, must be of sufficiently rigid construction to enable safe and damage free transport and storage of goods contained therein. These tote boxes are frequently designed so as to be stacked or mounted in a nesting relation for convenient transportation or storage of the tote boxes. In order to be stackable, the upper edge of the tote box is typically reinforced with a top rail or rim member which is adapted to receive another tote box stacked thereupon.

It is conventional to use a variety of materials for the construction of such tote boxes. Such materials typically consist of corrugated paperboard, corrugated plastic sheet, sheet metal and other such materials which are not sufficiently rigid to support a number of filled tote boxes in stacked relation. Therefore, it is also conventional to reinforce the corners of the tote boxes with structural supports so that a lower tote box of a stack of tote boxes can adequately support the load of the upper tote boxes and goods therein without deformation, possibly resulting in damage to the goods contained therein.

Typically these tote box corner supports and top rails require additional fasteners such as rivets, staples, screws or the like to secure the top rail and the corner support to the box itself. These fasteners add material costs and manufacturing steps to the construction of the tote box thereby resulting in an expensive and difficult to assemble tote box.

One patent which discloses a tote box having corner supports or enhancers and a top rail which are not held in place with additional fasteners such as rivets, staples, screws or the like is applicants' own U.S. Pat. No. 6,305,601. However, in each of the embodiments of the tote box disclosed in this patent, the corner enhancers extend outwardly from the generally planar surfaces of the tote box walls. Occasionally, one of the vertically oriented outer edges of a corner enhancer may catch on an obstacle such as a fork lift. The resultant force may cause at least one of the outer walls of the corner enhancer to deform and at least one of the interior walls of the corner enhancer to fold inward. When this occurs, the walls of the tote box may separate from the corner enhancers, resulting in a loss of integrity of the box structure as well as the ability to support the weight of another container stacked on top of it.

Accordingly, it is a primary objective of the present invention to provide a tote box which may withstand significant forces applied to the corner enhancers of the tote box.

SUMMARY OF THE INVENTION

The present invention is directed to a tote box which is assembled from a die cut box blank, corner enhancers, corner strengthener clips and a self-locking top rail. When folded into the appropriate shape, the die cut box blank results in a bottom, two opposed end walls, and two opposed side walls. The end walls and side walls have upper edges defining a top edge of the box. A pair of opposed walls preferably have holes into which reinforcing hand holds may be inserted to aid in manual handling of a loaded tote box.

To hold the erected box blank in an assembled relationship and to reinforce the top edge of the tote box, a channel shaped top rail extends around the top edge of the tote box. At least a portion of this top rail has a downwardly open channel formed between a pair of channel side walls. When the downwardly open channel of the piece is pushed down over the top edge of the erected box blank, the channel fits over a double thickness of the tote box formed from tabs or flaps of the box blank. The top rail is locked onto the top edge of the box as the result of an inwardly extending hook on at least one channel side wall which snaps beneath one or more tabs. The tabs may extend downwardly from the upper edges of the box walls or be integrally formed in the box walls, as disclosed in applicant's U.S. Pat. No. 6,305,601, which is fully incorporated by reference herein.

The top rail may be manufactured from a single piece of extruded plastic, aluminum or other material such as is disclosed in applicant's U.S. Pat. No. 6,305,601. However, the top rail may be alternatively constructed of multiple pieces such as the top rail disclosed in applicant's U.S. Pat. No. 6,349,877, which is fully incorporated by reference herein. The inwardly extending hook of at least one channel side wall of the top rail engages the tabs of the box walls thereby securing the top rail onto the top edge of the tote box without the need for further fasteners such as screws, rivets, or staples. The top rail preferably has a vertical lip which extends upwardly from the top rail. The vertical lip enables nested stacking of additional tote boxes. A first or upper tote box may be nestably stacked on a second or lower tote box by placing the bottom of the first tote box within the vertical lip of the top rail of the second or lower tote box.

Structural corner enhancers reside at each corner of the tote box to hold the erected side and end walls together in an assembled relationship and to stiffen the tote box corners. The corner enhancers provide a load path for the weight of the stacked tote boxes and their contents to be distributed downwardly and thereby provide structural integrity to the tote box and prevent side and end wall deformation. Each corner enhancer has a first and second open leg channel, each open leg channel being formed between a pair of leg channel walls. Each of the open leg channels has a width of approximately the thickness of the box blank. One of the end walls is held inside one of the open leg channels of a corner enhancer and one of the side walls is held inside the other open leg channel of the corner enhancer. In this manner, each corner enhancer functions to join together an end wall and a side wall in an orthogonal or right angle relationship. Upon assembly, each corner enhancer has an upper portion which may be located inside the downwardly open channel of the top rail.

Corner strengthener clips reside at the bottom of each corner enhancer to prevent the side and end walls of the box from becoming dislodged from the corner enhancers. They provide further structural integrity to the tote box and prevent deformation of the leg channel walls of the corner enhancers in the event something catches on one of the corner enhancers. Each corner strengthener clip has a receptacle formed between a pair of inner and outer receptacle walls, end walls and a bottom. The receptacle of the clip is generally L-shaped, having two arms. Each arm of the receptacle has a width of approximately the thickness of an inner leg channel wall of the corner enhancer so that the inner leg channel walls of the corner enhancer are held inside the arms of the receptacle. In this manner, each corner strengthener clip functions to stabilize the leg channel walls of the corner enhancer with which it is engaged.

In order to assemble the tote box of the present invention the die cut box blank is erected. The bottom ends of the corner enhancers are inserted into the receptacles of the corner strengthener clips to create corner enhancer assemblies. The side and end walls of the erected box blank are then inserted into the open leg channels of the corner enhancers. A side edge of each side wall and a corresponding side edge of an adjacent end wall are located inside the open leg channels of each of the corner enhancers in order to hold and maintain the walls in an erect vertical position, orthogonal to each other. Once the box blank has been folded, the corner enhancer assemblies assembled and the walls of the box blank inserted into the open leg channels of the corner enhancers at the corners of the box, the top rail is then placed over the upper edges of the box walls.

One advantage of the present invention is that the tote box can be assembled rapidly without the need for intermediate fastener joining steps and without the need for multiple rivets or fasteners such as have been conventional in prior art tote boxes as, for example, in the tote box disclosed in the assignee's own U.S. Pat. No. 5,037,027. Another advantage of the present invention is that the stackable tote box may be constructed to withstand loads accidentally placed upon the corner enhancers of the product.

BRIEF DESCRIPTION OF THE DRAWINGS

The objectives and features of the present invention will become more readily apparent when the following detailed description of the drawings is taken in conjunction with the accompanying drawings in which.

Figure 1:
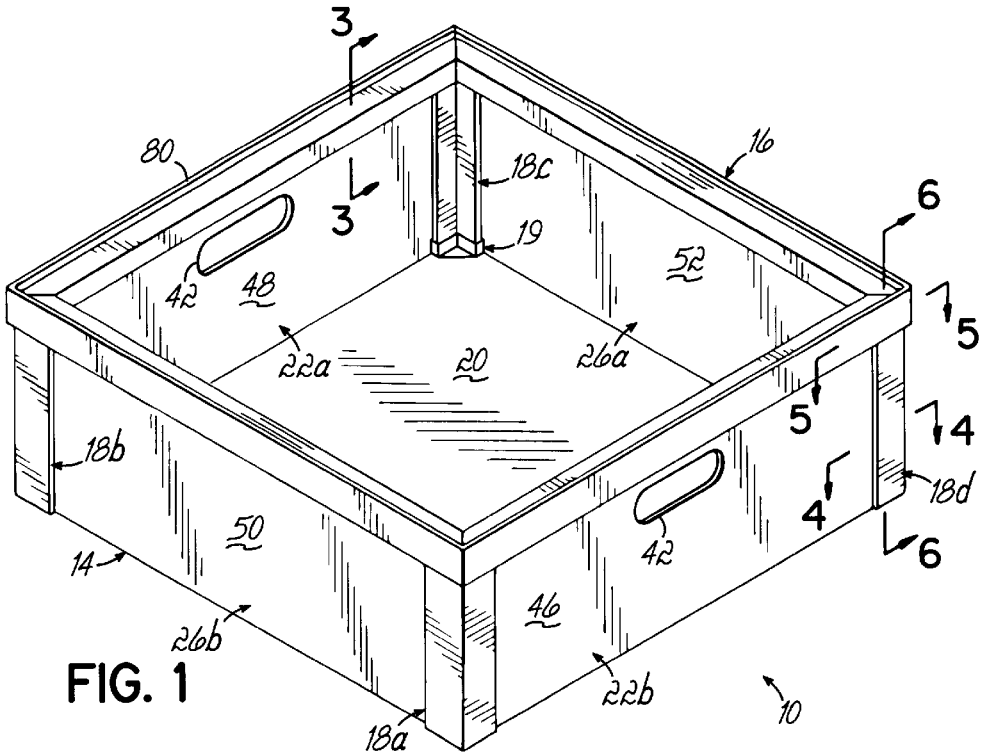
FIG. 1 is a perspective view of the assembled tote box of the present invention.

FIG; 4 is a cross-sectional view taken along the line 4—4 of FIG. 1.

Figure 5:
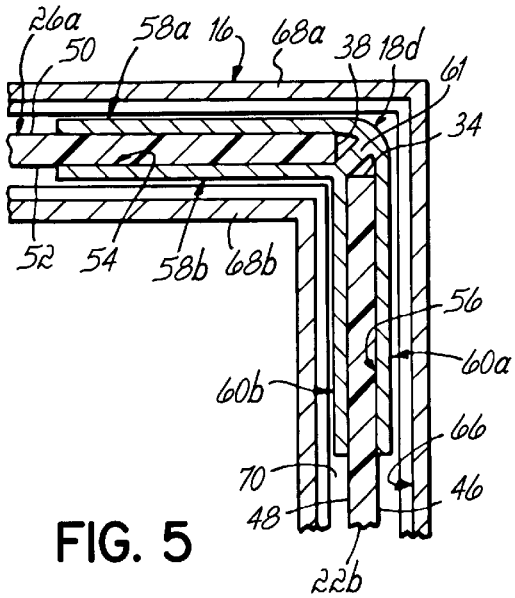

FIG. 5 is a cross-sectional view taken along the line 5—5 of FIG. 1.

Figure 6:
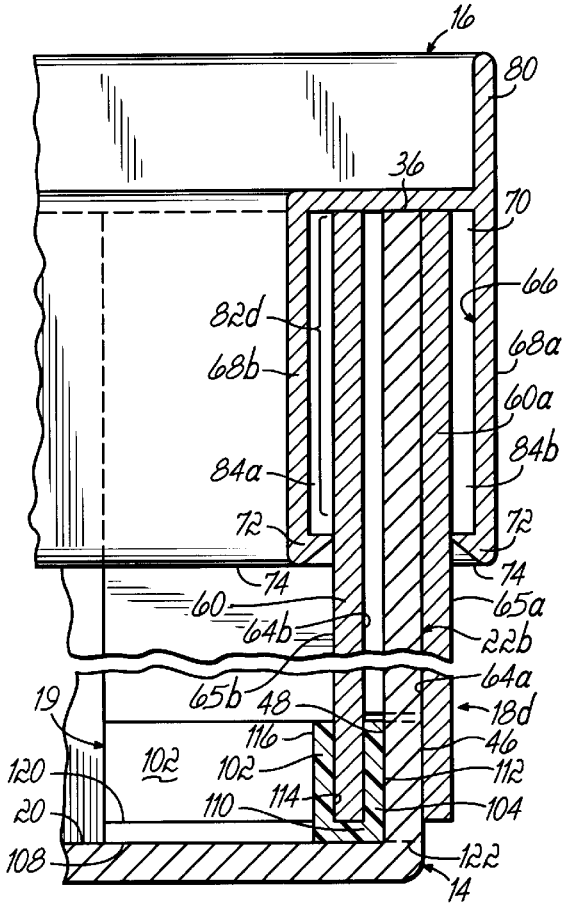

FIG. 6 is a cross-sectional view taken along the line 6—6 of FIG. 1.

Figure 7:
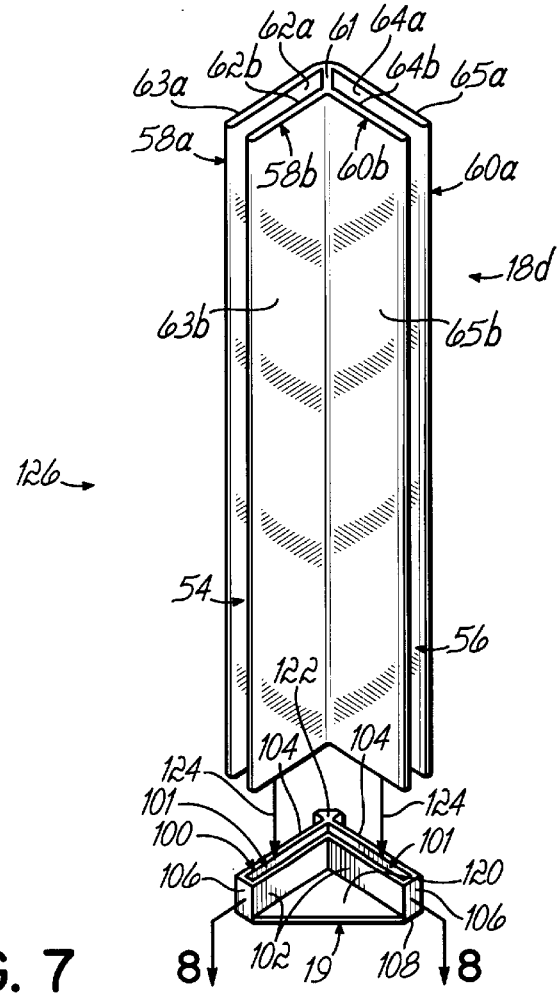

FIG. 7 is a disassembled perspective view of a corner enhancer assembly comprising a corner enhancer and a corner strengthener clip.

Figure 8:
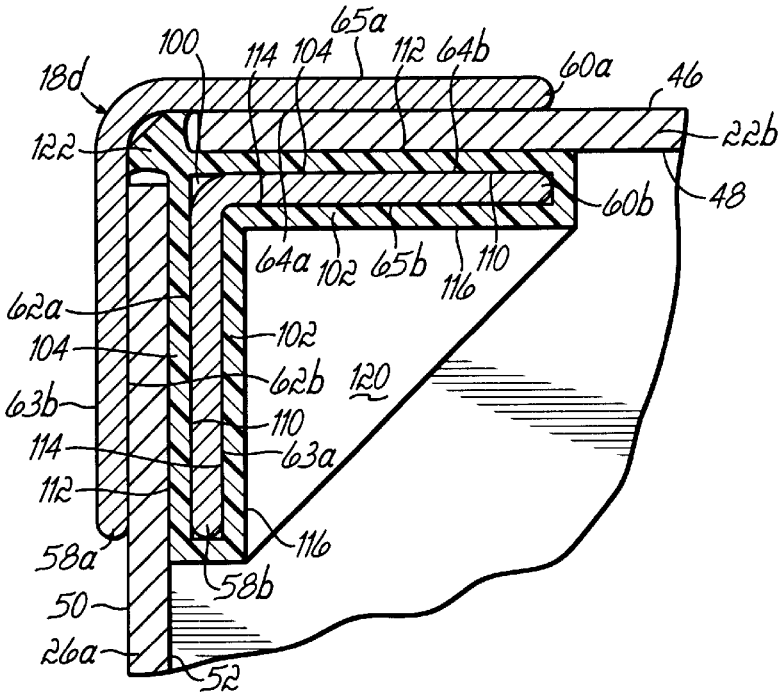

FIG. 8 is a cross-sectional view of a corner strengthener clip engaged with a corner enhancer taken along the line 8—8 of FIG. 7.

DETAILED DESCRIPTION OF THE INVENTION

Figure 2:
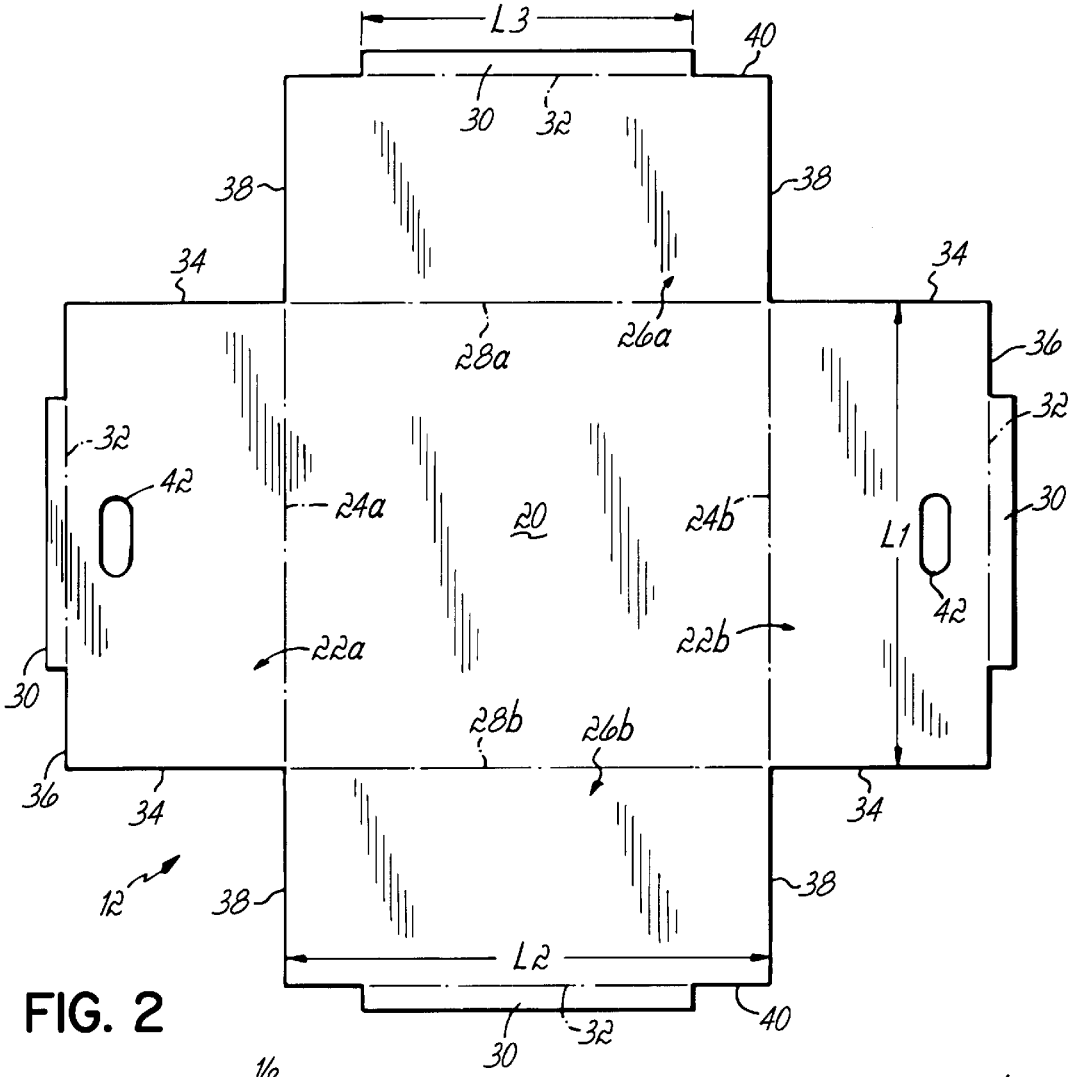
FIG. 2 is a top plan view of a box blank used to form the tote box of FIG. 1.

Referring to FIG. 1, there is illustrated an assembled tote box 10 according to the present invention. The tote box 10 is assembled from a uniform thickness box blank 12 as seen in FIG. 2 which is die cut or otherwise pre-cut from, preferably, corrugated plastic sheet. However, the box blank and resulting box may be made from any other suitable material. In one preferred embodiment, the box blank 12 is 5 millimeters thick and made from extruded corrugated plastic material. Depending upon the application, the box blank may be other thicknesses or materials as well.

Figure 1A:
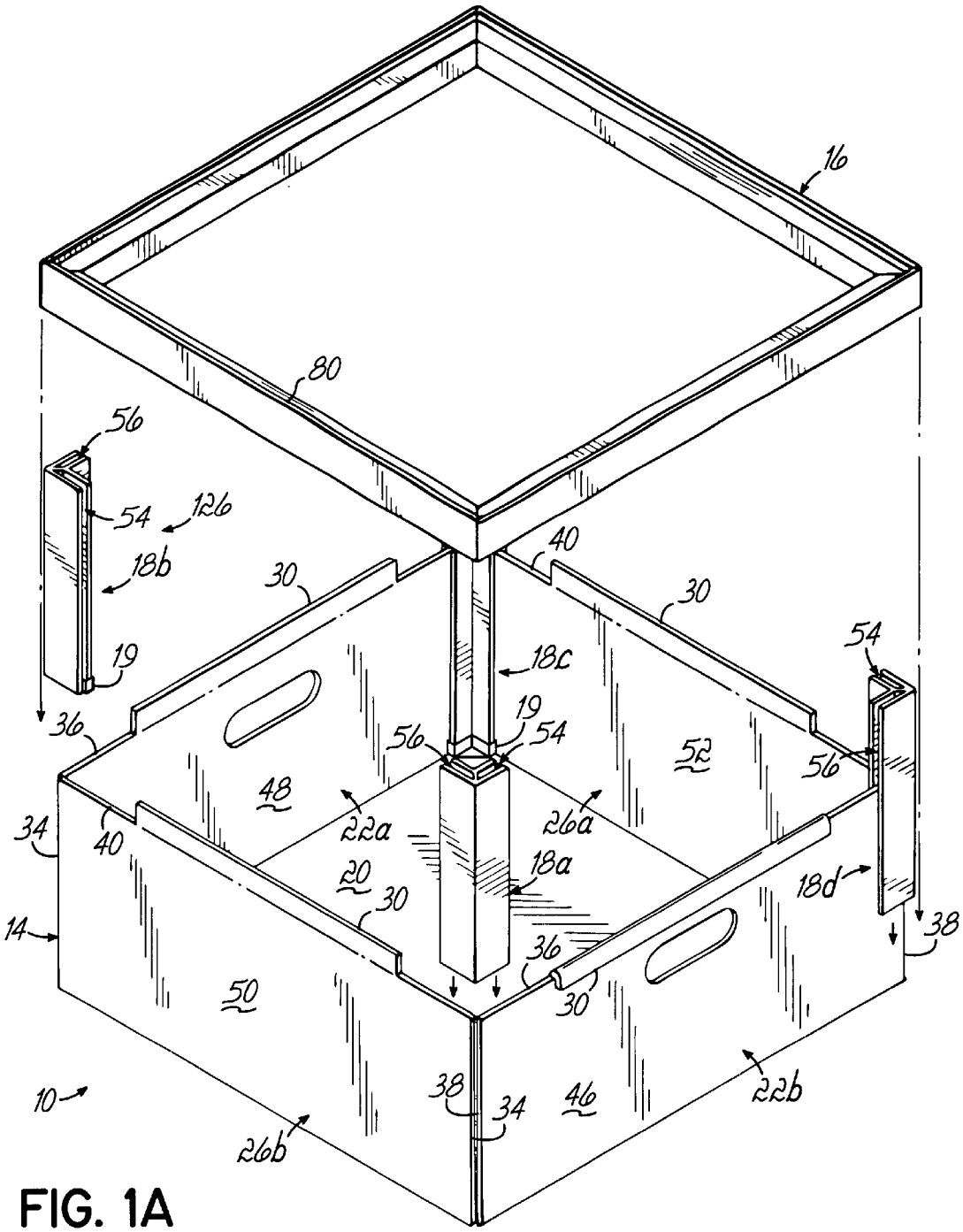
FIG. 1A is a partially disassembled perspective view of the tote box of FIG. 1.

As best illustrated in FIG. 1A, the tote box 10 comprises a box 14 formed from the foldable box blank 12 (shown in FIG. 2), a top rail 16, four corner enhancers 18*a*–18*d*, and four corner strengthener clips 19 (only one being shown in FIG.1).

Referring to FIGS. 1A and 2, the box blank 12 is folded along fold lines to form a box 14 illustrated in FIG. 1A. As best illustrated in FIG. 2, the box blank 12 has a bottom 20, two end walls 22*a* and 22*b* connected to the bottom with fold lines 24*a* and 24*b*, and two side walls 26*a*, 26*b* connected to the bottom 20 by fold lines 28*a*, 28*b*. In one preferred embodiment, each of the side walls 26*a*, 26*b* and each of the end walls 22*a*, 22*b* has a tab 30 which is joined to the wall with a fold line 32. However, it is within the contemplation of the present invention that the side walls or end walls have any number of tabs at various locations. As best illustrated in FIGS. 1A and 2, each end wall 22*a*, 22*b* has a pair of opposed side edges 34 and an upper edge 36. Similarly, each of the side walls 26*a*, 26*b* has a pair of opposed side edges 38 and an upper edge 40.

As best illustrated in FIG. 2, each of the opposed end walls 22*a,b* has an identical first length L1, and each of the opposed side walls 26*a,b* has an identical length L2. In one preferred embodiment of the present invention illustrated in FIG. 2, the lengths L1,L2 of the end walls 22*a,b* and side walls 26*a,b*, respectively are identical, resulting in a square box 14. However, for purposes of the present invention they may be of different lengths in order to create a rectangular box rather than a square box. Oval shaped holes 42 are cut through the end walls 22*a*,22*b* and may accommodate hand holds (not shown) which preferably are fabricated from plastic or aluminum but may be constructed of any material. Although the holes 42 are illustrated as being formed in the end walls, they may alternatively be placed in the side walls 26*a*, 26*b*. As best illustrated in FIG. 2, each of the tabs 30 has a length L3 less than the length of the side walls L2 and the length of the end walls L1 in order to leave space proximate the corners for the corner enhancers 18*a–d*. The tabs 30 may all be the same length as illustrated or alternatively of differing lengths. In either case, the tabs 30 must not interfere with the insertion and function of the corner enhancers 18*a–d*.

As best illustrated in FIG. 1A, once the side walls 26*a,b* and end walls 22*a,b* of the box blank are folded along fold lines 24*a,b* and 28*a,b* into a generally vertical orientation, the ends walls 22*a*,22*b* each have an outside surface 46 and an inside surface 48. Similarly, each of the side walls 26*a*,26*b* has an outside surface 50 and inside surface 52.

Figure 4:
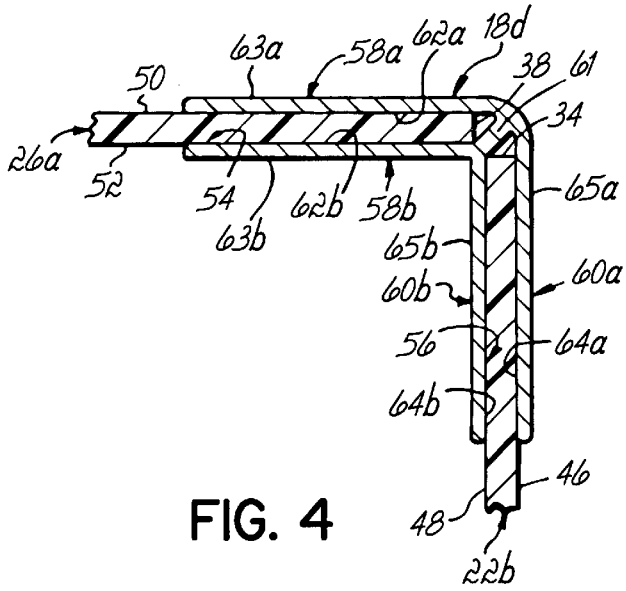

Each of the corner enhancers 18*a*–18*d* is identically configured and has a first open leg channel 54 and a second open leg channel 56. As best illustrated in FIG. 4, the first open leg channel 54 is formed between a pair of leg channel walls 58*a,b* and second open leg channel 56 is formed between a pair of leg channel walls 60*a,b*. The first and second open leg channels of each corner enhancer are separated by a separator 61. However, a portion of the separator 61 is cut away or removed at the bottom thereof in order to receive a portion of a corner strengthener clip 19. See FIGS. 7 and 8. Leg channel wall 58*a* has an inside surface 62*a* and an.outside surface 63*a*, respectively. Likewise, leg channel wall 58*b* has an inside surface 62*b* and an outside surface 63*b*, respectively. The distance between the inside surfaces 62*a* and 62*b* of the leg channel walls

58*a,b* defines the width of the first open leg channel 54, which is approximately the thickness of the box blank 12. Likewise, the leg channel wall 60*a* of the second open leg channel 56 has an inside surface 64*a* and an outside surface 65*a*, respectively. Leg channel wall 60*b* of the second leg channel 56 also has an inside surface 64*b* and an outside surface 65*b*. The distance between the inside surfaces 64*a* and 64*b* of the leg channel walls 60*a*,60*b* defines the width of the second open leg channel 56, which is also approximately the thickness of the box blank 12. Because the width of the first and second open leg channels are approximately equal and approximately equal to the thickness of the side and end walls of the box blank, one of the end walls 22*a,b* and one of the side walls 26*a,b* are frictionally held inside the open leg channels of each corner enhancer. One of the open leg channels of each corner enhancer receives one of an adjacent side wall and end wall while the other open leg channel of the corner enhancer receives the other one of the adjacent side wall and end walls. For example, as illustrated in FIGS. 1A and 4, corner enhancer 18*d* joins together end wall 22*b* and side wall 26*a*, a portion of end wall 22*b* including side edge 34 being received within the second open leg channel 56 while a portion of side wall 26*a* including side edge 38 is received within the first open leg channel 54 of the corner enhancer 18*d*. Thus, each corner enhancer 18*a–d* functions to hold and maintain one of the end walls and one of the side walls in an orthogonal relationship in order to maintain the structural integrity of the box without the need for separate fasteners before the top rail 16 is placed over the box 14 and corner enhancers 18*a–d*.

Each corner enhancer 18*a–d* preferably has a height approximately equal to the distance between the bottom of box 14 and the top edge of the box 14 (see FIG. 1A). However, corner enhancers of alternative heights may be used in accordance with the present invention.

Although one configuration of the corner enhancer is illustrated and described, other configurations of corner enhancers may be used in accordance with the present invention. For example, each corner enhancer may comprise an "L-shaped" inner piece and an "L-shaped" outer piece held together, the distance between the inner and outer pieces defining a pair of open leg channels of a width approximately equal to the thickness of the box blank.

Referring to FIG. 7, each of the corner strengthener clips 19 is identically configured and has a generally L-shaped receptacle 100 integrally formed therein. The receptacle 100 is formed between a pair of inner receptacle walls 102, a pair of outer receptacle walls 104, a pair of end walls 106 and a bottom 108. As best illustrated in FIG. 8, each of the outer receptacle walls 104 has an inside surface 110 and an outside surface 112, respectively. Likewise, inner receptacle walls 102 each have an inside surface 114 and an outside surface 116, respectively. The distance between the inside surfaces 110 and 114 of the outer and inner receptacle walls 104, 102 defines the width of each arm 101 of the receptacle 100, which is approximately the thickness of the inner leg channel walls 58*b*, 60*b* of each of the corner enhancers 18*a–*18*d*. Because the width of the receptacle 100 is approximately equal to the thickness of the leg channel walls 58*b*, 60*b* of each corner enhancer, the leg channel walls 58*b*, 60*b* may be frictionally held inside the arms 101 of the receptacle 100 of the corner strengthener clip 19, as illustrated in FIG. 8.

The corner strengthener clip 19 further comprises an outer anchor 122 and a generally planar inner portion 120 extending between the inner receptacle walls 102. The inner portion 120 of the corner strengthener clip 19 is generally coplanar with the bottom 108 of the receptacle 100. The anchor 122 extends outwardly from the receptacle 100 and fits generally between the first and second open leg channels 54 and 56 of a corner enhancer. In order to receive the anchor 122 of the corner strengthener clip 19, a portion of the separator 61 of the corner enhancer preferably is removed. However, variations of the corner strengthening clip made in accordance with the present invention may not require removal of a portion of the separator 61.

To assemble the box 14 illustrated in FIG. 1A from the box blank 12 illustrated in FIG. 2, the end walls 22*a*,22*b* are first folded upwardly along fold lines 24*a*,24*b*, respectively. Next, the side walls 26*a*,26*b* are folded upwardly along-fold lines 28*a*,28*b*, respectively.

Either prior to folding the box blank 12 into box 14 or thereafter, the corner strengthener clips 19 are attached to the corner enhancers 18*a–d* to create corner enhancer assemblies 126. Referring to FIG. 7, the inner open leg channel walls 58*b* and 60*b* of a corner enhancer (18*d* being shown) are inserted into the arms 101 of the receptacle 100 of a corner strengthener clip 19 by lowering the corner enhancer 18*d* in the direction of arrows 124. Because the arms 101 of the receptacle 100 of the corner strengthener clip 19 has a width of approximately the thickness of the inner leg channel walls 58*b* and 60*b* of the corner enhancer 18*d*, the corner enhancer 18*d* is frictionally held inside the receptacle 100 of the corner strengthener clip 19 to create a corner enhancer assembly 126.

Once the side walls 26*a,b* and end walls 22*a,b* of the box 14 are erected and the corner enhancers 18*a–d* have been attached to the corner strengthener clips 19, at each corner, one of the side walls 26*a,b* is inserted into one of the open leg channels 54,56 of one of the corner enhancers and one of the end walls 22*a,b* is inserted into the other open leg channel of the corner enhancer in order to hold and maintain one of the end walls and one of the side walls in an orthogonal, vertical orientation or position. Because each of the open leg channels 54, 56 has a width of approximately the thickness of the box blank, each of the end walls 22*a,b* and side walls 26*a,b* is frictionally held inside one of the open leg channels 54, 56 of one of the corner enhancers 18*a–d*. Once the box walls are erected and held together with the corner enhancers assemblies 126, the tabs 30 extending upwardly from each of the side and end walls are folded downwardly, either inwardly or outwardly. Although FIG. 1A illustrates a pair of tabs 30 folded outwardly of end wall 22*b*, at least one or all of the tabs 30 may be folded inwardly of the respective side or end wall of which the tab forms a part. Alternatively, the tabs may be integrally formed in the box walls as show in applicant's U.S. Pat. No. 6,305,601.

Once the side walls and end walls of the tote box are erected and partially inserted into the open leg channels of the corner enhancer assemblies 126 and the tabs folded downwardly, the final step in the assembly of the tote box is accomplished by snapping in place the top rail 16 over the top edge of the erected box. The top edge of the tote box is formed from upper edges 36 of end walls 22*a,b* and upper edges 40 of side walls 26*a,b*, respectively. Prior to securing the top rail 16, the tabs 30 must be folded downwardly upon the side and end walls. Once the tabs 30 are folded downwardly, the top rail 16 is placed over the top edge of the erected tote box.

Figure 3:
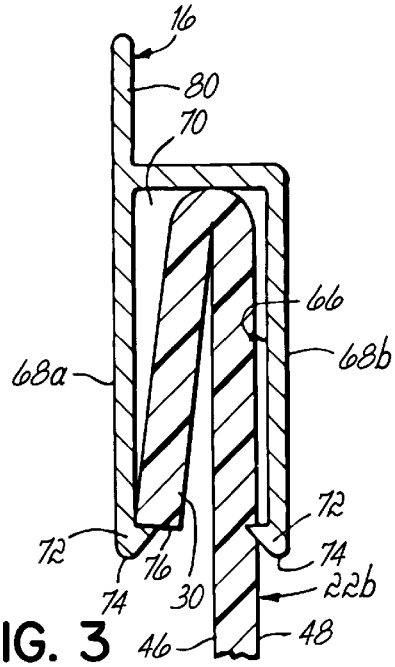
FIG. 3 is a cross-sectional view of a top rail and tote box wall taken along the line 3—3 of FIG. 1.

As shown in FIG. 3 the top rail 16 has a downwardly open channel 66 which is formed between two spaced channel side walls 68*a, b*. The channel 66 has an opening 70 of a width at least twice the thickness of the box blank and in one preferred embodiment, approximately three times the thickness of the box blank. As seen in FIG. 3, the channel opening 70 is of sufficient width to accommodate the end wall 22*b* and tab 30 folded outside thereof.

As illustrated in FIG. 3, an inwardly extending hook 72 is provided on bottom edge 74 of each channel side wall 68*a,b* in one preferred embodiment. However, the hook 72 may be located at any location of the channel side-wall, such as midway up the channel side wall. When the top rail 16 is snapped onto the erected tote box, one of the hooks 72 engages a bottom edge 76 of the downwardly folded tab 30 thereby securing the top rail 16 on the erected tote box as shown in FIG. 3. Once the top rail 16 is pressed onto the top edge of the tote box and one of the hooks 72 engages the downwardly folded tabs 30 of at least two of the side and end walls, the tote box is erected without the benefit of mechanical fasteners, rivets, staples, or the like. While the tab 30 is illustrated in FIG. 3 as being folded downwardly on the outside of the side wall, it could just as well be folded downwardly on the inside of this same wall. Although FIG. 3 illustrates an inwardly extending hook 72 on a bottom edge 74 of each channel side wall 68*a,b*, alternatively, only one of the channel side walls 68*a,b* could have an inwardly extending hook 72.

As illustrated in FIGS. 5 and 6, each of the corner enhancers 1*a–d* has an upper portion (only upper portion 82*d* being illustrated in FIGS. 5 and 6). These upper portions 82*a–d* of the corner enhancers 18*a–d* may be located inside the downwardly open channel 66 formed between the pair of channel side walls 68*a,b* of the top rail 16 as best illustrated in FIG. 6. Because the width of the downwardly open channels is approximately twice the thickness of the box blank so as to fit over the downwardly folded tabs of the side and end walls, at each corner of the tote box there are gaps 84*a* and 84*b* located between the outside surfaces of the corner enhancer and the inside surfaces of the channel side walls of the top rail (see FIG. 6).

The top rail 16 of the present invention also has a vertically extending lip 80 on an outside upper edge thereof. The lip 80 facilitates the stacking of a second tote box in a nested relationship upon a tote box 10 of the present invention. The weight of the tote box stacked on the top rail is distributed around the top rail 16 and supported by the corner enhancers 18*a–d* of the present invention. Although one continuous, uniform configuration of top rail 16 is illustrated and described, the top rail 16 may assume other configurations as well, such as for example slots may be formed in the vertical lip 80 of the top rail 16 to receive strapping.

While I have described several preferred embodiments of the present invention, persons skilled in the art will appreciate changes and modifications which may be made without departing from the spirit of the invention. For example, the downwardly folded tabs may be located on only two opposed walls of the tote box rather than on all four walls to effectively secure the top rail to the tote box. Therefore, I intend to be limited only by the scope of the following claims and equivalents thereof.

I claim:

1. A tote box with a self-locking top rail comprising:

a box formed from a foldable box blank, said box having a bottom, two opposed side walls and two opposed end walls, said side walls and end walls having upper edges defining a top edge of the box, a plurality of corner enhancers, each of said corner enhancers having first and second open leg channels, each open leg channel being formed between inner and outer leg channel walls, each of said open leg channels having a width defined between planar inside surfaces of said leg channel walls, one of said end walls being located inside one of said first and second open leg channels and one of said side walls being located inside the other of said first and second open leg channels, a plurality of corner strengthener clips engaged with said corner enhancers, each of said corner strengthener clips having a receptacle adapted to receive a portion of one of said corner enhancers, and a top rail extending around the top edge of said box, at least a portion of said top rail having a downwardly open channel formed between a pair of channel side walls, said downwardly open channel being fitted over said upper edges of said side walls and said end walls.

2. The tote box of claim 1 wherein said receptacle of said corner strengthener clip is defined by inner and outer receptacle walls, end walls and a bottom.

3. The tote box of claim 1 wherein said foldable box blank is of a uniform thickness.

4. The tote box of claim 1 wherein said receptacle is adapted to receive said inner leg channel walls of one of said corner enhancers.

5. The tote box of claim 1 wherein at least two of said walls of said box have at least one tab for engaging said top rail.

6. The tote box of claim 5 wherein said tabs are downwardly folded from said upper edges of said box walls.

7. The tote box of claim 5 wherein said top rail has an inwardly extending hook on at least one of said channel side walls, said hook engaging said tabs and locking said top rail over said upper edges of said end and side walls of said box.

8. The tote box of claim 1 wherein said foldable box blank is made of corrugated plastic sheet.

9. The tote box of claim 1 wherein said corner enhancers are extruded.

10. The tote box of claim 1 wherein said top rail has a vertical lip on an outside upper edge thereof for facilitating stacking of a second tote box on top of said tote box.

11. A tote box with a self-locking top rail comprising:

a box formed from a foldable box blank, said box having a bottom, two opposed side walls and two opposed end walls, said side walls and end walls having upper edges defining a top edge of the box, at least two of said walls having tabs on said upper edges thereof which are downwardly folded, a plurality of corner enhancers, each of said corner enhancers having first and second open leg channels, each open leg channel being formed between inner and outer leg channel walls, each of said open leg channels having a width defined between planar inside surfaces of said leg channel walls, one of said end walls being located inside one of said first and second open leg channels and one of said side walls being located inside the other of said first and second open leg channels, a corner strengthener clip secured to each of said corner enhancers, said corner strengthener clip having inner and outer receptacle walls, end walls and a bottom defining a receptacle, a portion of said inner leg channel wall of said corner enhancer being located in said receptacle, and a top rail extending around the top edge of said box, at least a portion of said top rail having a downwardly open channel formed between a pair of channel side walls, said downwardly open channel being fitted over said upper edges of said side walls and said end walls of said box and -an upper portion of each of said corner enhancers, said downwardly open channel having a width of approximately twice the thickness of said box blank so as to fit over said downwardly folded tabs, at least one of said channel side walls having an inwardly extending hook, said hook engaging said tabs and locking said top rail over said upper edges of said end and side walls.

12. The tote box of claim 11 wherein said foldable box blank is made of corrugated plastic sheet.

13. The tote box of claim 11 wherein said top rail has a vertical lip on an outside upper edge thereof for facilitating stacking of a second tote box on top of said tote box.

14. A tote box comprising:

a box formed from a foldable box blank, said box having a bottom, two opposed side walls and two opposed end walls, said side walls and end walls having upper edges defining a top edge of the box, a plurality of corner enhancers, each of said corner enhancers having first and second open leg channels, each open leg channel being formed between inner and outer leg channel walls, each of said open leg channels having a width defined between planar inside surfaces of said leg channel walls, one of said end walls being located inside one of said first and second open leg channels and one of said side walls being located inside the other of said first and second open leg channels, and a corner strengthener clip secured to each of said corner enhancers, said corner strengthener clip having a receptacle formed between inner and outer receptacle walls, said inner leg channel walls of said corner enhancer being located in said receptacle.

15. The tote box of claim 14 further comprising a top rail extending around the top edge of said box, at least a portion of said top rail having a downwardly open channel formed between a pair of channel side walls, said downwardly open channel being fitted over said upper edges of said side walls and said end walls and an upper portion of each of said corner enhancers.

16. The tote box of claim 15 wherein at least two of said walls of said box have at least one tab for engaging said top rail.

17. The tote box of claim 16 wherein said tabs are downwardly folded from said upper edges of said box walls.

18. The tote box of claim 17 wherein said downwardly open channel has a width of approximately twice the thickness of said box blank so as to fit over said downwardly folded tabs, at least one of said channel side walls having an inwardly extending hook, said hook engaging said tabs and locking said top rail over said upper edges of said end and side walls.

19. The tote box of claim 15 wherein said top rail has a vertical lip on an outside upper edge thereof for facilitating stacking of a second tote box on top of said tote box.

20. A method of assembling a tote box with a self-locking top rail, said top rail having a downwardly open channel defined by a top and two channel side walls, said method comprising:

folding a box blank into a box, said box having a bottom, two opposed side walls and-two opposed end walls, said side walls and end walls having upper edges defining a top edge of the box, at least two opposed walls each having at least one tab, securing portions of corner enhancers within receptacles of corner strengthener clips to create corner enhancer assemblies, locating portions of said side and end walls of said box inside first and second open leg channels of said corner enhancers, each of said open leg channels being formed between inner and outer leg channel walls, and securing said top rail over upper edges of said walls of said box.

21. The method of claim 20 further comprising locking said top rail over said upper edges of said box walls by engaging said tabs with hooks extending inwardly from channel side walls of said top rail.

* * * * *